US012729031B2

(12) United States Patent
Kobayashi et al.

(10) Patent No.: US 12,729,031 B2
(45) Date of Patent: Sep. 8, 2026

(54) CAN BODY

(71) Applicants: Toyo Seikan Co., Ltd., Tokyo (JP); Toyo Seikan Group Holdings, Ltd., Tokyo (JP)

(72) Inventors: Tomokazu Kobayashi, Tokyo (JP); Hayato Fukumoto, Kanagawa (JP); Tomohiko Nakamura, Kanagawa (JP); Kota Kamiyama, Kanagawa (JP)

(73) Assignees: Toyo Seikan Co., Ltd., Tokyo (JP); Toyo Seikan Group Holdings, Ltd., Tokyo (JP)

( * ) Notice: Subject to any disclaimer, the term of this patent is extended or adjusted under 35 U.S.C. 154(b) by 0 days.

(21) Appl. No.: 18/662,140

(22) Filed: May 13, 2024

(65) Prior Publication Data

US 2024/0300687 A1 Sep. 12, 2024

Related U.S. Application Data

(63) Continuation of application No. PCT/JP2022/035449, filed on Sep. 22, 2022.

(30) Foreign Application Priority Data

Dec. 9, 2021 (JP) ..... 2021-199850

(51) Int. Cl.
*B65D 1/16* (2006.01)

(52) U.S. Cl.
CPC ..... *B65D 1/165* (2013.01)

(58) Field of Classification Search
CPC . B65D 1/165; B65D 1/46; B65D 1/16; B65D 1/42; B65D 17/02; B65D 17/4012; B65D 17/00

(Continued)

(56) References Cited

U.S. PATENT DOCUMENTS 5,105,973 A * 4/1992 Jentzsch ..... B65D 1/165 220/606
5,325,696 A 7/1994 Jentzsch et al.

(Continued)

FOREIGN PATENT DOCUMENTS

CN U-202063307 U 12/2011
CN U-2023903013 U 10/2014

(Continued)

OTHER PUBLICATIONS

ISR and Written Opinion cited in corresponding PCT Appl. PCT/JP2022/035449, with English Translation.

(Continued)

*Primary Examiner* — Robert Poon
(74) *Attorney, Agent, or Firm* — BACON&THOMAS, PLLC

(57) ABSTRACT

There is provided a can body made of aluminum alloy and having a bottomed cylindrical shape including a can bottom 11 and a can barrel 12. The can bottom includes a dome part 111 provided in a center of the can bottom, and an annular convex part 112 provided on an outer circumferential edge of the dome part. The annular convex part includes a recess 112A provided to continue to the dome part, a ground part 112B, and an inner circumferential wall 112C extending from the ground part to the recess. An outer diameter of the can barrel is 50 mm to 59 mm, the height from the ground part to an upper end of the can body is 120 mm to 190 mm. A recess depth is 0.5 mm to 0.8 mm, and a ground diameter is φ44.0 mm to 47.0 mm.

2 Claims, 6 Drawing Sheets

(58) Field of Classification Search
USPC ..... 220/608
See application file for complete search history.

(56) References Cited

U.S. PATENT DOCUMENTS

| | | | | |
|---|---|---|---|---|
| 6,296,139 | B1 * | 10/2001 | Hanafusa | B65D 1/165 220/608 |
| 7,740,148 | B2 | 6/2010 | Rajagopalan et al. | |
| 2001/0045116 | A1 | 11/2001 | Hanafusa et al. | |
| 2009/0026214 | A1 * | 1/2009 | Yuan | B65D 1/165 220/608 |
| 2020/0189824 | A1 * | 6/2020 | Legresy | B65D 79/0081 |
| 2022/0097896 | A1 * | 3/2022 | Kobayashi | B21D 51/26 |
| 2023/0150711 | A1 | 5/2023 | Kobayashi | |
| 2023/0173570 | A1 | 6/2023 | Fukumoto | |

FOREIGN PATENT DOCUMENTS

| | | | |
|---|---|---|---|
| JP | 9-285832 | A | 11/1997 |
| JP | 2000-190961 | A | 7/2000 |
| JP | 2000-211624 | A | 8/2000 |
| JP | 2014-054999 | A | 3/2014 |
| JP | 2016-043991 | A | 4/2016 |
| JP | 2020-100446 | A | 7/2020 |
| JP | 2021-031181 | A | 3/2021 |
| JP | 2021-138441 | A | 9/2021 |
| WO | WO2017/008961 | A1 | 1/2017 |
| WO | WO2021/186829 | A1 | 9/2021 |

OTHER PUBLICATIONS

ISR and Written Opinion cited in corresponding PCT Appl. PCT/JP2022/035449 dated Jun. 5, 2024, with English Translation.
Notice of Reasons for Rejection issued in corresponding JP Patent Appln. No. 20221-199850 with machine translation.
Office Action issued in corresponding CN Patent Appln. No. 202280077532.8 with machine translation.
EESR cited in corresponding European Appln. No. 22903822.9 dated Oct. 29, 2025.
Notice of Reasons for Refusal cited Japanese Patent Appln. No. 2021-199850 dated Oct. 27, 2025, with translation.
Office Action issued in corresponding Vietnam Patent Appln. No. 1-2024-03476 with English Translation.

* cited by examiner

| | RECESS DEPTH [mm] | GROUND DIAMETER [mm] | THICKNESS OF ALUMINUM ALLOY [mm] | CAN HEIGHT [mm] | OUTER DIAMETER OF CAN BARREL [mm] | CONTENT SPECIFICATION | | EVALUATION (SINGLE) | EVALUATION (CASE) |
|---|---|---|---|---|---|---|---|---|---|
| | | | | | | LIQUID TEMPERATURE [°C] | INTERNAL PRESSURE [kPa] | | |
| COMPARATIVE EXAMPLE1-1 | 0.68 | 43.0 | 0.22 | 155.3 | 57.2 | 35 | 400 | No | No |
| | | | | | | | 500 | No | No |
| COMPARATIVE EXAMPLE1-2 | 0.68 | 43.5 | 0.22 | 155.3 | 57.2 | 35 | 400 | Yes | Yes |
| | | | | | | | 500 | No | No |
| EXAMPLE 1-1 | 0.68 | 44.0 | 0.22 | 155.3 | 57.2 | 35 | 400 | Yes | Yes |
| | | | | | | | 500 | Yes | Yes |
| EXAMPLE 1-2 | 0.68 | 44.5 | 0.22 | 155.3 | 57.2 | 35 | 400 | Yes | Yes |
| | | | | | | | 500 | Yes | Yes |
| EXAMPLE 1-3 | 0.68 | 45.0 | 0.22 | 155.3 | 57.2 | 35 | 400 | Yes | Yes |
| | | | | | | | 500 | Yes | Yes |
| EXAMPLE 1-4 | 0.68 | 45.5 | 0.22 | 155.3 | 57.2 | 35 | 400 | Yes | Yes |
| | | | | | | | 500 | Yes | Yes |
| EXAMPLE 1-5 | 0.68 | 46.0 | 0.22 | 155.3 | 57.2 | 35 | 400 | Yes | Yes |
| | | | | | | | 500 | Yes | Yes |
| EXAMPLE 1-6 | 0.68 | 46.5 | 0.22 | 155.3 | 57.2 | 35 | 400 | Yes | Yes |
| | | | | | | | 500 | Yes | Yes |
| EXAMPLE 1-7 | 0.68 | 47.0 | 0.22 | 155.3 | 57.2 | 35 | 400 | Yes | Yes |
| | | | | | | | 500 | Yes | Yes |
| COMPARATIVE EXAMPLE1-3 | 0.68 | 47.5 | 0.22 | 155.3 | 57.2 | 35 | 400 | No | Yes |
| | | | | | | | 500 | No | No |

*FIG. 5*

| | RECESS DEPTH [mm] | GROUND DIAMETER [mm] | THICKNESS OF ALUMINUM ALLOY [mm] | CAN HEIGHT [mm] | OUTER DIAMETER OF CAN BARREL [mm] | CONTENT SPECIFICATION | | EVALUATION (SINGLE) | EVALUATION (CASE) |
|---|---|---|---|---|---|---|---|---|---|
| | | | | | | LIQUID TEMPERATURE [°C] | INTERNAL PRESSURE [kPa] | | |
| COMPARATIVE EXAMPLE2-1 | 0.40 | 45.4 | 0.22 | 155.3 | 57.2 | 35 | 400 | No | No |
| | | | | | | | 500 | No | No |
| COMPARATIVE EXAMPLE2-2 | 0.45 | 45.4 | 0.22 | 155.3 | 57.2 | 35 | 400 | Yes | No |
| | | | | | | | 500 | No | No |
| EXAMPLE 2-1 | 0.50 | 45.4 | 0.22 | 155.3 | 57.2 | 35 | 400 | Yes | Yes |
| | | | | | | | 500 | Yes | Yes |
| EXAMPLE 2-2 | 0.55 | 45.4 | 0.22 | 155.3 | 57.2 | 35 | 400 | Yes | Yes |
| | | | | | | | 500 | Yes | Yes |
| EXAMPLE 2-3 | 0.60 | 45.4 | 0.22 | 155.3 | 57.2 | 35 | 400 | Yes | Yes |
| | | | | | | | 500 | Yes | Yes |
| EXAMPLE 2-4 | 0.65 | 45.4 | 0.22 | 155.3 | 57.2 | 35 | 400 | Yes | Yes |
| | | | | | | | 500 | Yes | Yes |
| EXAMPLE 2-5 | 0.70 | 45.4 | 0.22 | 155.3 | 57.2 | 35 | 400 | Yes | Yes |
| | | | | | | | 500 | Yes | Yes |
| EXAMPLE 2-6 | 0.75 | 45.4 | 0.22 | 155.3 | 57.2 | 35 | 400 | Yes | Yes |
| | | | | | | | 500 | Yes | Yes |
| EXAMPLE 2-7 | 0.80 | 45.4 | 0.22 | 155.3 | 57.2 | 35 | 400 | Yes | Yes |
| | | | | | | | 500 | Yes | Yes |
| COMPARATIVE EXAMPLE2-3 | 0.85 | 45.4 | 0.22 | 155.3 | 57.2 | 35 | 400 | No | No |
| | | | | | | | 500 | No | No |

*FIG. 6*

CAN BODY

CROSS-REFERENCE TO RELATED APPLICATIONS

The present application is a continuation application of PCT international application No. PCT/JP2022/035449 filed on Sep. 22, 2022 which claims priority from Japanese Patent Application No. 2021-199850 filed on Dec. 9, 2021, and the entire contents of which are hereby incorporated by reference.

TECHNICAL FIELD

The present invention relates to a can body, and specifically to a can body having a reformed can bottom.

RELATED ART

Conventionally, there has been known a drawn and ironed can made of aluminum alloy (two-piece can) as a container filled with contents such as beverage. The can body of a drawn and ironed can made of aluminum alloy is obtained by punching a circular plate out of a plate material made of aluminum alloy and drawing the circular plate, and therefore to mold a shallow cup member having a bottomed cylindrical shape. Then, the cup member is redrawn and ironed to integrally mold a can bottom and a can barrel.

This can body is required to reduce the plate thickness of the can barrel in the light of resource saving. In particular, when the content is carbonated beverage, the can bottom is designed to have a sufficient pressure strength even through the can body is formed to be thinner. To be more specific, the can bottom includes a dome part whose center part being concave to the inside of the can body, and an annular convex part formed around the dome part, and bottom reforming is applied to the annular convex part to secure the pressure strength against the thinning. See, for example, Japanese Patent Application Laid-Open No. 2000-190961. The entire contents of this disclosure are hereby incorporated by reference. Also the can body is required to have a sufficient drop strength against the drop impact, in order to be distributed to the market. See, for example, U.S. Pat. No. 7,740,148. The entire contents of this disclosure are hereby incorporated by reference.

SUMMARY

An aspect of the present invention provides a can body made of aluminum alloy and having a bottomed cylindrical shape including: a can bottom; and a can barrel having a cylindrical shape around a can axis and extending from an outer circumference of the can bottom along the can axis. The can bottom includes a dome part provided in a center of the can bottom, and an annular convex part continuing to an outer circumferential edge of the dome part and circumferentially projecting to an outside of the can body along a can axis direction. The annular convex part includes a recess provided to continue to the dome part and having a curved surface being convex to the outside of the can body in a radial direction, a ground part configured to support the can body, and an inner circumferential wall extending from the ground part to the recess. An outer diameter of the can barrel is 50 mm to 59 mm, and a can height from the ground part to an upper end of the can barrel is 120 mm to 190 mm. A recess depth is 0.5 mm to 0.9 mm, and a ground diameter is φ44.0 mm to 47.0 mm in a vertical cross-sectional view including the can axis. The recess depth is a distance between a portion of the recess on an outer surface of the can body which is the farthest from the can axis and a portion of the ground part on the outer surface of the can body which is the closest to the can axis in the radial direction. The ground diameter is a diameter of a most projecting portion of the ground part facing downward in the can axis direction.

BRIEF DESCRIPTION OF THE DRAWINGS

FIG. 5 is a table illustrating the results of tests of dropping the can body with various ground diameters for examples and comparative examples of the drawn and ironed can made of aluminum alloy according to an embodiment of the invention; and FIG. 6 is a table illustrating the results of tests of dropping the can body with various recess depths for examples and comparative examples of the drawn and ironed can made of aluminum alloy according to an embodiment of the invention.

DETAILED DESCRIPTION

Incidentally, in recent years, a slim two-piece can having a smaller diameter (for example, 204 diameter) has been increasingly popular because of its stylish design, instead of a general two-piece can (211 diameter) containing beer and so forth. See, for example, Chinese Utility Model Registration No. 203903013. The entire contents of this disclosure are hereby incorporated by reference.

In the case of the bottom reforming to deform the annular convex part into the can body as described above, when the can body after the bottom reforming is filled with content, the liquid level of the content is raised even though the amount of content is not changed before the bottom reforming. This affects the filling amount of the content. The can body having a small diameter such as the 204 diameter is more affected than the can body having 211 diameter. That is, when the diameter of the can body is small, a change in the liquid level of the content filled in the can body is greater than that in the can body having 211 diameter, due to the deformation by the bottom reforming. Therefore, there is a problem that it is difficult to fully satisfy to secure a predetermined filling amount, the pressure strength, and the drop strength.

The present invention has been achieved considering the above-described circumstances to address the above-described problem. It is therefore an object of the invention to secure the pressure strength and the drop strength while securing a predetermined filling amount of the content.

Hereinafter, an embodiment of the invention will be described with reference to the drawings.

In the description below, the same reference numbers indicate the same functional sections, and therefore repeated description for each of the drawings is omitted.

Figure 1:
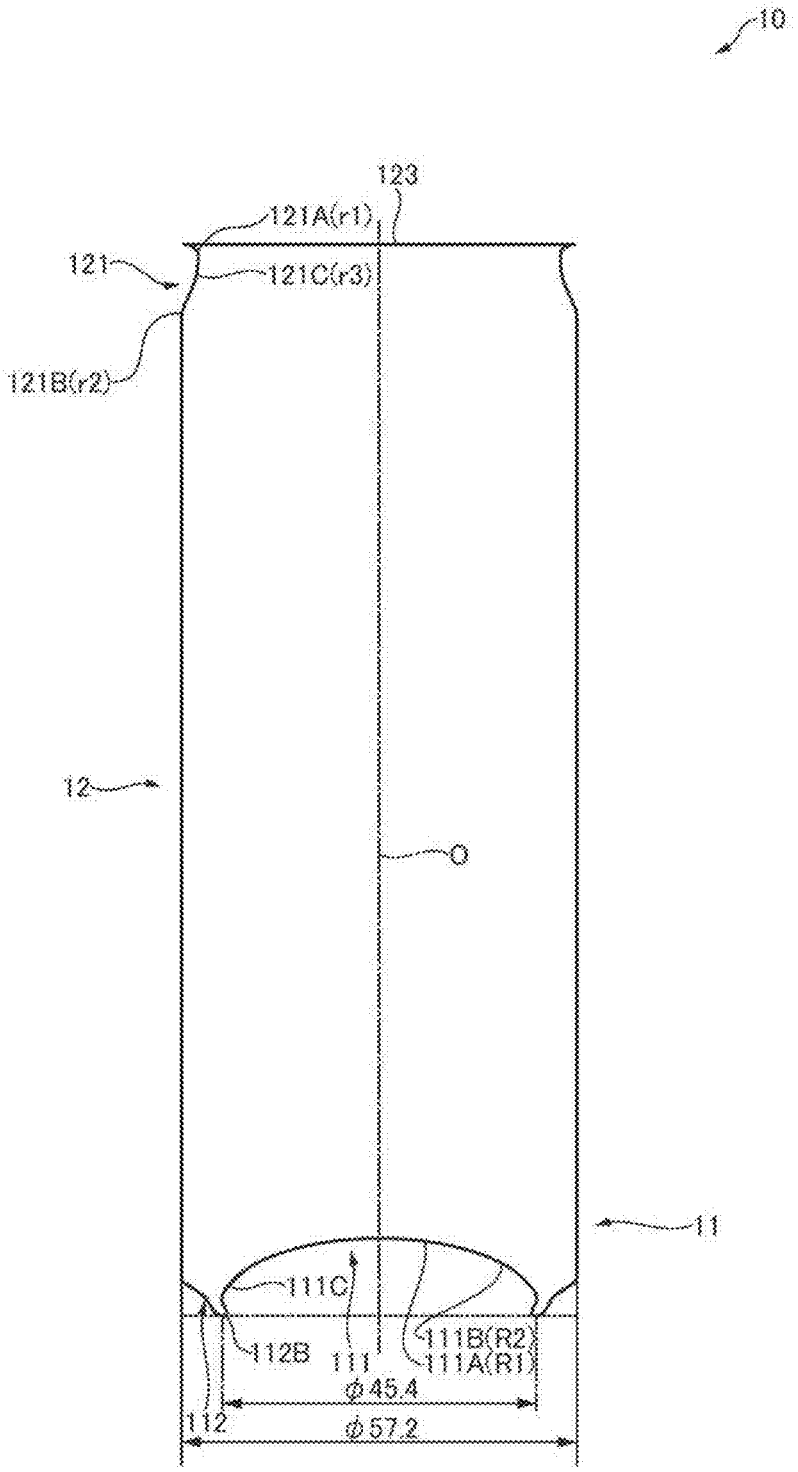
FIG. 1 is a vertical cross-sectional view along a can axis of a can body.

FIG. 1 is a vertical cross-sectional view along a can axis O of a can body 10 and schematically illustrates the can body 10. Here, FIG. 1 is a diagrammatic drawing illustrating the cross-sectional shape of the can body 10 without the plate thickness of the can body 10.

As illustrated in FIG. 1, the can body 10 has a bottomed cylindrical shape including a can bottom 11, and a can barrel 12 having a cylindrical shape around a can axis O and extending from the outer circumference of the can bottom 11 along the can axis O.

The can bottom 11 includes a dome part 111 and an annular convex part 112. The dome part 111 is provided in the center of the can bottom 11, and the annular convex part 112 continues from the outer circumferential edge of the dome part 11 and circumferentially projects to the outside of the can body 10 along the direction of the can axis O to support the can body 10.

Figure 2:
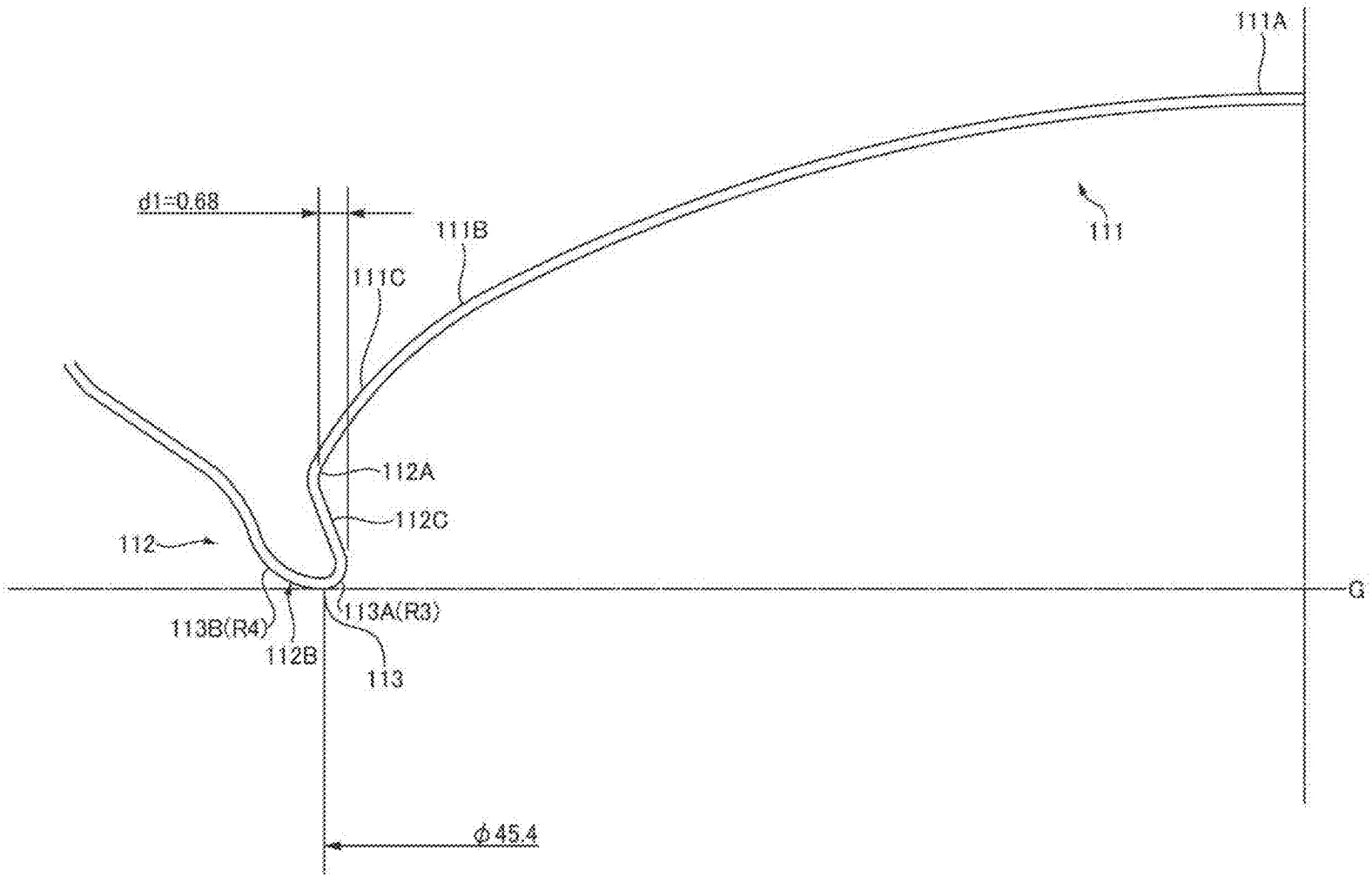
FIG. 2 is a partial enlarged view illustrating a can bottom of the can body illustrated in FIG. 1.

The annular convex part 112 is provided to continue to the dome part 111, and includes a recess 112A having a curved surface which is convex to the outside of the can body 10 in the radial direction, a ground part 112B configured to support the can body 10, and an inner circumferential wall 112C extending from the ground part 112B to the recess 112A (see FIG. 2).

EMBODIMENT

The can body according to an embodiment of the invention is, for example, a drawn and ironed can made of aluminum alloy.

The can body according to the embodiment is a drawn and ironed can made of aluminum alloy having the configuration like the can body 10 illustrated in FIG. 1, and the shape and the size of each of the parts are optimized. Therefore, hereinafter, the shape and the size of the can body 10 as a drawn and ironed can made of aluminum alloy according to the embodiment will be descried, with reference to FIG. 1 and so forth.

The can body 10 as a drawn and ironed can made of aluminum alloy is obtained by, for example: punching a circular plate out of a plate material made of aluminum alloy; drawing the circular plate to mold a cup member having a bottomed cylindrical shape; redrawing and ironing the cup member to integrally mold the can bottom 11 and the can barrel 12; and trimming, necking and flanging the opening end of the can barrel 12.

The can body 10 includes the can bottom 11, and the can barrel 12 having a cylindrical shape around the can axis O and extending from the outer circumference of the can bottom 11 along the can axis O. The can body 10 has a bottomed cylindrical shape formed by the can bottom 11 and the can barrel 12. The can bottom 11 and the can barrel 12 have the same shape along the entire circumference around the can axis O.

The height of the can body 10 from the ground part (described later) of the can bottom 11 to the upper end of the can barrel 12 is 120 mm to 190 mm. With the example illustrated in FIG. 1, the can height is 155.0 mm.

The outer diameter of the can barrel 12 is 50 mm to 59 mm. With the example illustrated in FIG. 1, the outer diameter is 57.2 mm.

FIG. 2 is an enlarged cross-sectional view illustrating the can bottom 11. FIG. 2 is a partial enlarged cross-sectional view illustrating the can bottom 11 illustrated in FIG. 1.

The can bottom 11 includes the dome part 111 and the annular convex part 112.

As illustrated in FIG. 2, the dome part 111 is provided in the center of the can bottom 11, and has a plurality of curved surfaces including a concave curved surface like a dome which is concave into the can barrel 12 along the direction of the can axis O.

With the example illustrated in FIG. 1, the dome part 111 includes two curved surfaces including a first dome 111A and a second dome 111B, and a tapered part 111C.

The first dome 111A is formed in the center of the can bottom 11, and includes a concave curved surface being concave into the can barrel 12 along the direction of the can axis O and having a radius of curvature R1. The second dome 111B is located around the first dome 111A and provided outside of the first dome 111A in the radial direction to continue to the outer circumferential edge of the first dome 111A, and includes a concave curved surface being concave into the can barrel 12 and having a radius of curvature R2. The radius of curvature R2 of the second dome 111B is smaller than the radius of curvature R1 of the first dome 111A.

It is preferred that the thickness of the aluminum alloy of the first dome 111A on the can axis O (hereinafter simply referred to as "thickness of aluminum alloy) is 0.18 mm to 0.26 mm. When the thickness of aluminum alloy is excessively small, the possibility of cracking the can barrel is increased in the process of redrawing and ironing, and therefore the yield rate may be decreased. On the other hand, when the thickness of aluminum alloy is excessively large, the amount of material to be used is increased. Therefore, both cases fail to meet the request for resource saving. Accordingly, the thickness of aluminum alloy is within the above-described range, and consequently it is possible to thin the can body to attempt the resource saving, and prevent the can barrel from being cracked to improve the yield rate.

The dome part 111 may have a plurality of curved surfaces with different radius of curvatures as the example illustrated in FIG. 1. In addition, the curved surface may have a radius of curvature varying gradually and smoothly, as well as the curved surface having a fixed radius of curvature. In addition, a well-known dome shape is applicable.

The tapered part 111C is a surface provided on the outer circumferential part of the second dome 111B. One end of the tapered part 111C continues to the outer circumferential edge of the second dome 111B, and the other end continues to the recess 112A described later. By this means, the diameter of the tapered part 111C is gradually increased from the second dome 111B to the recess 112A. The tapered part 111C may be a straight line in a vertical cross-sectional view including the can axis O, or a curved surface projecting to the inside or the outside of the can body 10.

The annular convex part 112 circumferentially projects from the outer circumferential edge of the dome part 111 to the outside of the can body 10 along the direction of the can axis O. With the example illustrated in FIG. 2, the annular convex part 112 includes the recess 112A, the ground part 112B, and the inner circumferential wall 112C.

The recess 112A is provided to continue to the outer circumferential edge of the dome part 111, and includes a curved surface being convex to the outside of the can body 10 in the radial direction. It is preferred that the radius of curvature of the curved surface of the recess 112A is 0.3 mm to 1.2 mm. It is preferred that the height of the recess 112A, that is, a distance between a ground portion 113 of the ground part 112B (the most projecting portion of the ground part 112B facing downward in the direction of the can axis O and contacting a ground plane G) and the portion of the recess 112A on the outer surface of the can body 10 which is the farthest from the can axis O in the radial direction is 1 mm to 4 mm. By this means, it is possible to secure the amount of content and the pressure strength. Here, the recess 112A may have a plurality of curved surfaces having different radius of curvatures of 0.3 mm to 1.2 mm.

When the can body 10 is placed on the approximately horizontal ground plane (horizontal plane) G, the ground portion 113 contacts the ground plane G, so that the can body 10 is supported by the ground part 112B. The ground part 112B includes two convex curved surfaces on both sides sandwiching the ground portion 113.

To be more specific, as illustrated in FIG. 1 and FIG. 2, the ground part 112B includes a first convex curved surface 113A formed on a side close to the can axis O and a second convex curved surface 113B formed on a side far from the can axis O, with respect to the ground portion 113. It is preferred that a radius of curvature R3 of the first convex curved surface 113A is 0.4 mm to 0.7 mm, and a radius of curvature R4 of the second convex curved surface 113B is 1.6 mm to 2.2 mm. By this means, it is possible to secure the drop strength.

The inner circumferential wall 112C is provided between the ground part 112B and the recess 112A, and inclined to gradually decrease the diameter of the inner circumferential wall 112C from the recess 112A to the ground part 112B along the direction of the can axis O. It is preferred that the angle of inclination of the inner circumferential wall 112C, that is, the angle formed between the inner circumferential wall 112C and the can axis O is 15 degrees to 30 degrees.

It is preferred that the annular convex part 112 is formed to have a recess depth of 0.5 mm to 0.9 mm and a ground diameter of φ44.0 mm to 47.0 mm, in a vertical cross-sectional view including the can axis O illustrated in FIG. 1.

Here, a recess depth d1 is a distance between the portion of the recess 112A on the outer surface of the can body 10 which is the farthest from the can axis O and the portion of the ground part 112B on the outer surface of the can body 10 which is the closest to the can axis O in the radial direction.

In addition, the ground diameter is the diameter of the ground portion 113 of the ground part 112B. With the example illustrated in FIG. 1, the recess depth d1 is 0.7 mm, and the ground diameter is φ45.5 mm. With the above-described configuration, it is possible to fully satisfy and effectively secure the amount of content, the pressure strength, and the drop strength.

The can barrel 12 has a cylindrical shape around the can axis O and extends from the outer circumference of the can bottom 11 along the can axis O. A neck 121 is provided in the upper end of the can barrel 12 and formed such that the outer diameter of the can barrel 12 is gradually decreased toward the top of the can barrel along the can axis O. A can lid (not illustrated) having a diameter smaller than that of the can barrel 12 is provided in the neck 121. Here, with the example illustrated in FIG. 1, the minimum outer diameter of the neck 121 is 52.4 mm.

The neck 121 includes a concave curved surface 121A formed on the upper end to be concave into the can body 10 in the radial direction of the can body 10 and having a radius of curvature r1, and a convex curved surface 121B formed on the lower end to be convex to the outside of the can body 10 in the radial direction of the can body 10 and having a radius of curvature r2. The neck 121 also includes a concave curved surface 121C formed between the concave curved surface 121A on the upper end and the convex curved surface 121B on the lower end. The concave curved surface 121C is concave into the can body 10 in the radial direction of the can body 10 and has a radius of curvature r3. A flange 123 is formed on the opening end of the can body 10, that is, on the upper end of the neck 121. With the example illustrated in FIG. 1, the radius of curvature r1 is 1.5 mm, the radius of curvature r2 is 5.0 mm, and the radius of curvature r3 is 10.0 mm. However, the values of the radius of curvatures are merely an example, and are by no means limiting.

<Modification 1>

Figure 3:
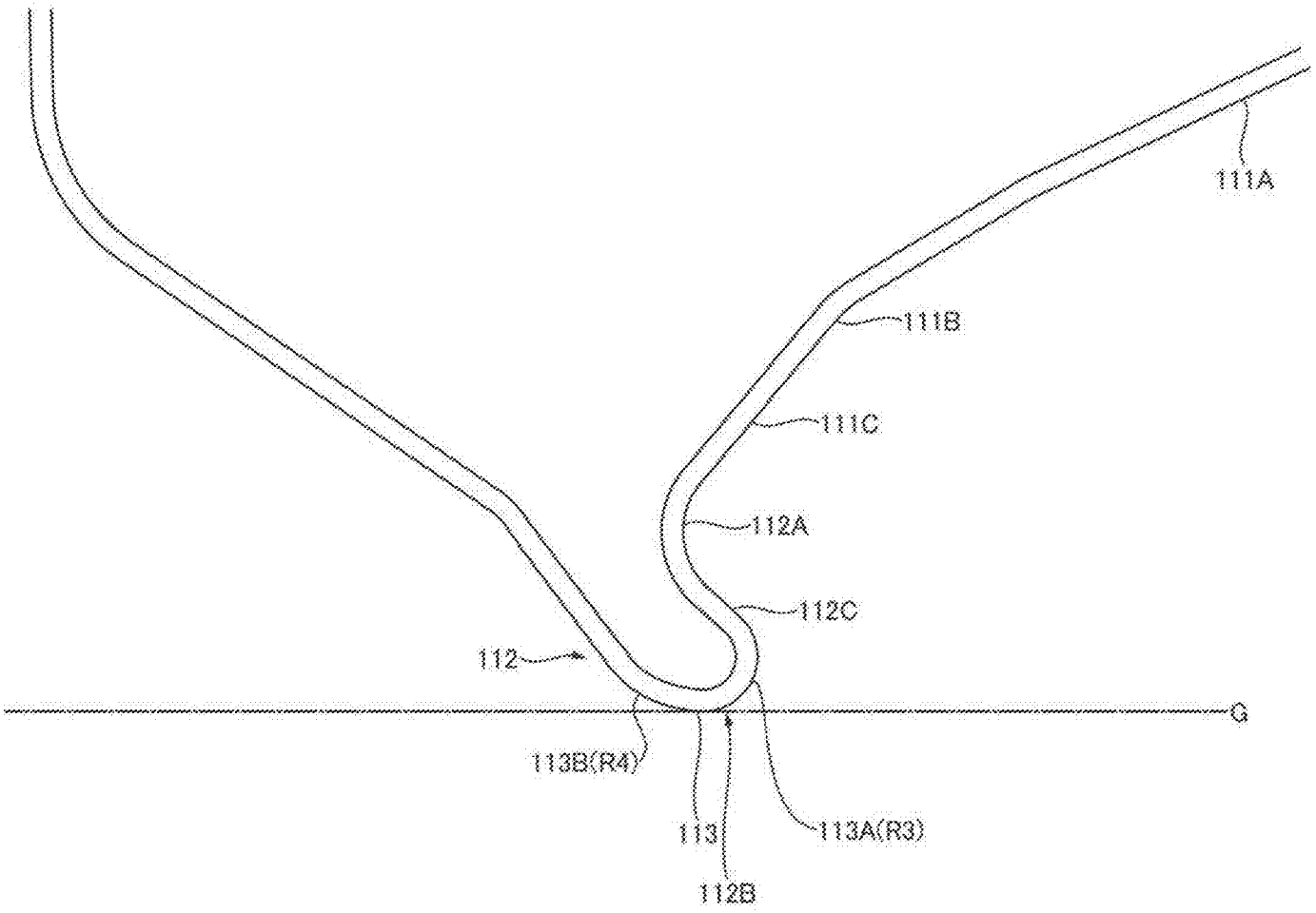
FIG. 3 is an enlarged cross-sectional view illustrating Modification 1 of the can bottom of a drawn and ironed can made of aluminum alloy according to an embodiment of the invention.

Hereinafter, Modification 1 of the can body according to the above-described embodiment will be described. FIG. 3 is an enlarged view illustrating the can bottom 11 in a vertical cross-sectional view along the can axis O of the can body according to Modification 1 (the can axis O is not illustrated in FIG. 3).

As illustrated in FIG. 3, the radius of curvature of the recess 112A is greater, and the distance of the inner circumferential wall in a vertical cross-sectional view is shorter in the modification, than the can body according to the above-described embodiment.

Figure 4:
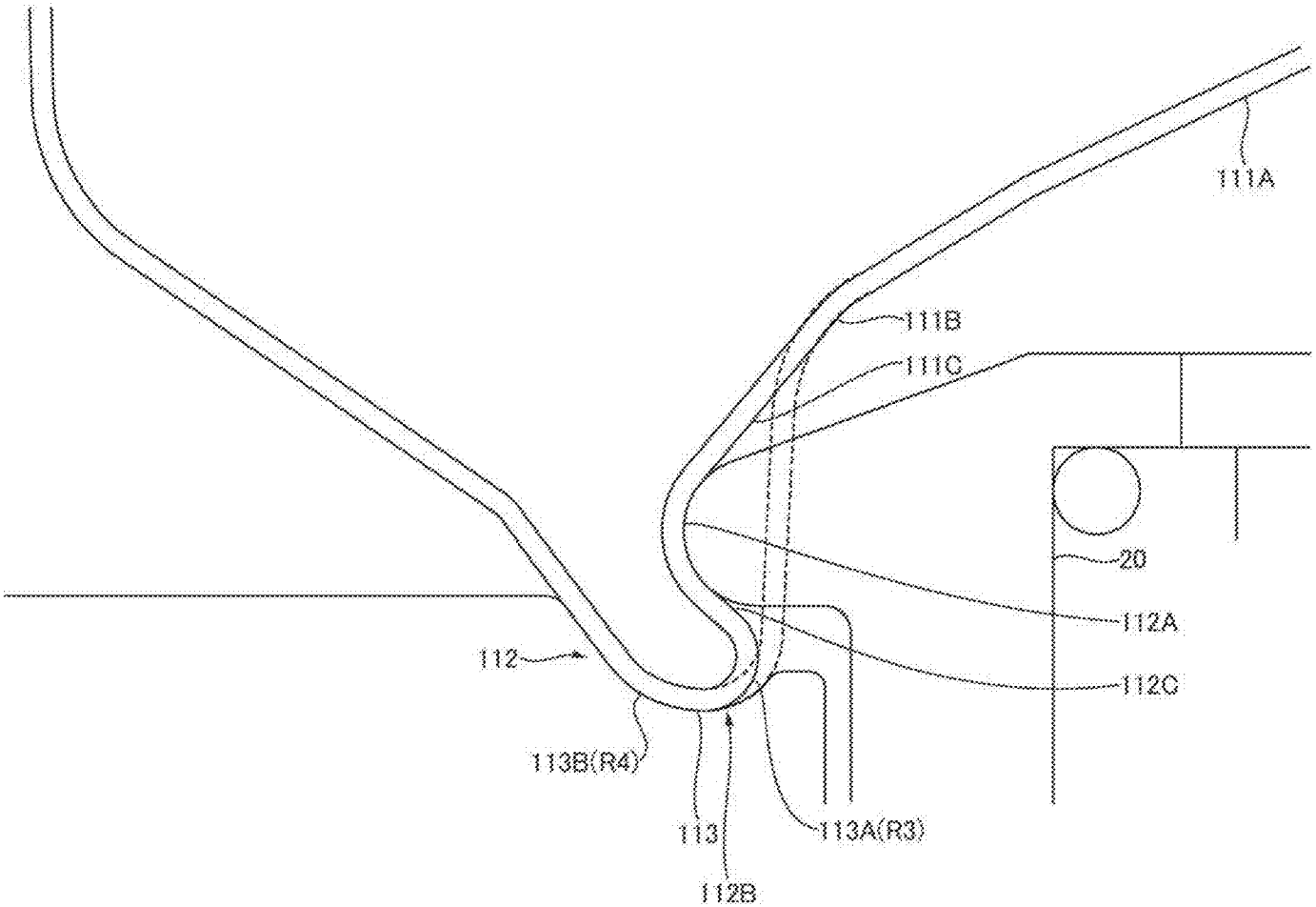
FIG. 4 is an enlarged cross-sectional view illustrating Modification 1 of the can bottom of the drawn and ironed can made of aluminum alloy according to an embodiment of the invention.

To obtain the annular convex part 112 as illustrated in FIG. 3, for example, a predetermined reform roll 20 is used as illustrated in FIG. 4 to apply bottom reforming. That is, the annular convex part extending from the second dome 111B of the dome part 111 to the outside of the can body along the direction of the can axis O is pressed by the reform roll 20 to the outside in the radial direction, and therefore is deformed. By this means, the recess 112A is formed depending on the shape of the reform roll 20 and the amount of pressing the reform roll 20, the tapered part 111C is formed on the recess 112A, and the inner circumferential wall 112C is formed under the recess 112A.

Here, with the modification, an example of applying the bottom reforming by molding the annular convex part with use of the reform roll has been described. However, the method of applying the bottom reforming is not limited to this, but other methods may be adopted accordingly.

FIG. 5 and FIG. 6 are tables illustrating the results of drop tests for the can body 10 with adjusted parts in size. FIG. 5 and FIG. 6 illustrate the results of two types of drop tests including "single drop test" and "case drop test". Each of the drop tests was conducted under the following conditions.

(1) Single Drop Test

As an example of the test, the can body 10 was filled with 335 ml of carbonated water, sealed with the can lid, sufficiently shaken, and dropped as a single body.

In this single drop test, a drop surface is provided by preparing one piece of material for cardboard cartons for packaging used to transport product cans, and putting the material on a block made of gray cast iron processed to be a flat surface whose top surface has an angle of inclination of 10 degrees. The can body 10 freely fell to the drop surface from the height at which the shortest distance from the ground part 112B to the drop surface was 20 cm while the ground part 112B faced downward and the can axis O was along the vertical direction.

(2) Case Drop Test

As an example of the test, 24 can bodies 10 each of which was filled with 355 ml of carbonated water and sealed with the can lid were accommodated in a rectangular parallelepiped cardboard carton for packaging used to transport product cans, sufficiently shaken, and dropped.

In this case drop test, a drop surface is provided by placing a dull-finished SPCC iron plate having a thickness of 20 mm on a horizontal concrete ground. The cardboard carton for packaging freely fell to the drop surface from the height at which the shortest distance from the cardboard carton for packaging to the iron plate was 15 cm, while the ground part 112B of each of the accommodated can bodies 10 faced downward, and the longitudinal direction of the horizontal cardboard carton for packaging was inclined for 20 degrees.

Each of the tables illustrated in FIG. 5 and FIG. 6 lists: "recess depth" denoting a distance between the portion of the recess 112A on the outer surface of the can body 10 which is the farthest from the can axis O and the portion of the ground part 112B on the outer surface of the can body 10 which is the closest to the can axis O in the radial direction; "ground diameter" denoting the diameter of the ground portion 113 of the ground part 112B; "thickness of aluminum alloy" denoting the thickness of the aluminum alloy of the first dome 111A on the can axis O; "can height" denoting the height of the can body from the ground part 112B to the upper end of the can barrel 12; "outer diameter of can barrel" denoting the outer diameter of the can barrel 12; "content specification" including "liquid temperature" and "internal pressure" of the carbonated water filled in the can body 10; and "evaluation" for the deformation of the dome part 111 or the annular convex part 112.

FIG. 5 illustrates the results of drop tests using the can body 10 according to examples and comparative examples where the thickness of the aluminum alloy is 0.22 mm, the can height is 155.3 mm, the recess depth is 0.68 mm, the outer diameter of the can barrel is 57.2 mm, and the ground diameter varies from 43.0 mm to 47.5 mm by 0.5 mm.

FIG. 6 illustrates the results of drop tests using the can body 10 according to examples and comparative examples where the thickness of the aluminum alloy is 0.22 mm, the can height is 155.3 mm, the ground diameter is 45.4 mm, the outer diameter of the can barrel is 57.2 mm, and the recess depth varies from 0.40 mm to 0.85 mm by 0.5 mm.

In the tables illustrated in FIG. 5 and FIG. 6, the results of all the drop tests according to the examples and the comparative examples are indicated in the columns "evaluation." The drop tests were conducted under the conditions where a drawn and ironed can made of aluminum alloy was used as the can body 10, the liquid temperature of the content filled in the can body 10 was 35 degrees Celsius, the internal pressures of the can body resting before being shaken were 400 kPa and 500 kPa.

In the columns "evaluation", when the angle of inclination of the can barrel 12 is smaller than 2 degrees and the dome part 111 is not reversed while the single can body after the drop test is placed on a horizontal plane and stands by itself, the result is evaluated as "pass", and "Yes" is indicated. On the other hand, when the angle of inclination of the can barrel 12 is equal to or greater than 2 degrees, or even part of the dome part 111 is reversed while the can body stands by itself, the result is evaluated as "fail", and "No" is indicated.

As seen from the table illustrated in FIG. 5, when the ground diameter is 43.0 mm (comparative example 1-1), both of two types of can bodies 10 having internal pressures 400 kPa and 500 kPa, respectively, fail in the single drop test and the case drop test. When the ground diameter is 43.5 mm (comparative example 1-2), the can body 10 having the internal pressure of 500 kPa fails in both the single drop test and the case drop test. When the ground diameter is 47.5 mm (comparative example 1-3), the dome part 111 is not deformed only in the case where the internal pressure is 400 kPa in the case drop test, and the other cases are evaluated as fails.

Meanwhile, when the ground diameter is 44.0 mm to 47.0 mm (examples 1-1 to 1-7), the two types of can bodies 10 having the internal pressures 400 kPa and 500 kPa, respectively, pass both the single drop test and the case drop test.

In addition, as seen from the table illustrated in FIG. 6, when the recess depth is 0.4 mm (comparative example 2-1), the two types of can bodies 10 having the internal pressures 400 kPa and 500 kPa, respectively, fail in both the single drop test and the case drop test. When the recess depth is 0.45 mm (comparative example 2-2), only the case where the internal pressure is 400 kPa in the single drop test is evaluated as a pass, and the other cases are evaluated as fails. When the recess depth is 0.85 mm (comparative example 2-3), the two types of can bodies 10 having the internal pressures 400 kPa and 500 kPa, respectively, fail in both the single drop test and the case drop test.

Meanwhile, when the recess depth is 0.50 mm to 0.80 mm (examples 2-1 to 2-7), the two types of can bodies 10 having the internal pressures of 400 kPa and 500 kPa, respectively, pass both the single drop test and the case drop test.

As described above, according to the embodiment, the shape and the size of the can body is optimized, and the bottom reforming is applied to the can bottom 11 to make the can bottom 11 have the recess depth of 0.5 mm to 0.8 mm, and the ground diameter of φ44.0 mm to 47.0 mm. By this means, it is possible to secure the pressure strength and the drop strength while securing a predetermined filling amount of the content in the can body 10.

The invention claimed is:

1. A can body made of aluminum alloy and having a bottomed cylindrical shape comprising:

a can bottom; and a can barrel having a cylindrical shape around a can axis and extending from an outer circumference of the can bottom along the can axis, the can bottom including:

a dome part provided in a center of the can bottom; and an annular convex part continuing to an outer circumferential edge of the dome part and circumferentially projecting to an outside of the can body along a can axis direction, the annular convex part including:

a recess provided to continue to the dome part and having a curved surface being convex to the outside of the can body in a radial direction;

a ground part configured to support the can body; and an inner circumferential wall extending from the ground part to the recess, the ground part including:

a first convex curved part and a second convex curved part, which sandwich a most projecting portion of the ground part facing downward in the can axis direction, wherein the first convex curved part is formed on a side close to the can axis and the second convex curved part is formed on a side far from the can axis wherein an outer diameter of the can barrel is 50 mm to 59 mm, a can height from the ground part to an upper end of the can barrel is 120 mm to 190 mm, a thickness of the aluminum alloy of the dome part on the can axis is 0.18 mm to 0.26 mm, in a vertical cross-sectional view including the can axis, a recess depth is 0.5 mm to 0.9 mm, a ground diameter is 44.0 mm to 47.0 mm, a radius of curvature of the first convex curved part is 0.4 mm to 0.7 mm, and a radius of curvature of the second convex curved part is 1.6 mm to 2.2 mm, provided that the recess depth is a distance between a portion of the recess on an outer surface of the can body which is the farthest from the can axis and a portion of the ground part on the outer surface of the can body which is the closest to the can axis in the radial direction, and the ground diameter is a diameter of a most projecting portion of the ground part facing downward in the can axis direction, the inner circumferential wall includes an inclined surface, and an angle formed between the inclined surface and the can axis is 15 degrees to 30 degrees, a radius of curvature of the recess is 0.3 mm to 1.2 mm; and a distance between the most projecting portion of the ground part facing downward in the can axis direction and the portion of the recess on the outer surface of the can body which is the farthest from the can axis is 1 mm to 4 mm, and the dome part includes a tapered part having one end continuing to an outer circumferential edge of the dome part and the other end continuing to the recess.

2. The can body according to claim 1, wherein:

the dome part includes a first dome formed in the center of the can bottom and being concave into the can barrel along the can axis direction, and a second dome provided outside of the first dome in the radial direction to continue to an outer circumferential edge of the first dome and being concave into the can barrel; and a radius of curvature of the second dome is smaller than that of the first dome.

* * * * *